US006119365A

United States Patent [19]

Wüller et al.

[11] Patent Number: 6,119,365

[45] **Date of Patent: *Sep. 19, 2000**

[54] AUTOMATICALLY OPERATING CLEANING INSTALLATION FOR WORKPIECES

[75] Inventors: Karl-Heinz Wüller, Simmerath; Otfried Meyer, Nideggen, both of Germany

[73] Assignee: Dürr Ecoclean GmbH, Filderstadt, Germany

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/927,620

[22] Filed: Sep. 11, 1997

[30] Foreign Application Priority Data

Sep. 12, 1996 [DE] Germany ..... 196 37 086

[51] Int. Cl.[7] ..... F26B 19/00

[52] U.S. Cl. ..... 34/218; 34/227; 34/228

[58] Field of Search ..... 34/218, 219, 227, 34/228, 85, 82; 134/102.3, 102.2, 102.1

[56] References Cited

U.S. PATENT DOCUMENTS

| | | | |
|---|---|---|---|
| 5,661,872 | 9/1997 | Meyer et al. | 15/309.2 |
| 5,730,163 | 3/1998 | Meyer et al. | 134/102.2 |

FOREIGN PATENT DOCUMENTS

| | | |
|---|---|---|
| 34 19 028A1 | 11/1985 | Germany . |
| 37 34 200A1 | 4/1989 | Germany . |
| 41 22 864A1 | 1/1993 | Germany . |
| 44 25 765A1 | 1/1996 | Germany . |
| 44 40 146A1 | 5/1996 | Germany . |
| 2 283 906A | 5/1995 | United Kingdom . |

*Primary Examiner*—Henry Bennett
*Assistant Examiner*—Malik N. Drake

[57] ABSTRACT

In an automatically operating cleaning installation for removing treating and/or machining residues from workpieces, comprising a cleaning station having associated therewith a channel for receiving at least one workpiece to be cleaned, a workpiece transportation device for introducing the workpieces to be cleaned into the channel and for removing the cleaned workpieces from the channel, and at least one blow nozzle directed into the interior of the channel and thus onto the workpieces to be cleaned for acting upon the workpieces with a stream of blow air, an air feeder, in particular, in the form of a ventilator, for supplying air to the blow nozzle at a pressure of at most approximately 0.5 bar being connected to the blow nozzle upstream thereof, and the channel including an outlet for withdrawing the used blow air, in order to optimize the cleaning effect, a steam supplying device for introducing steam into the stream of blow air and a separating device for separating from the used blow air contaminated condensate originating from the steam are provided.

29 Claims, 2 Drawing Sheets

AUTOMATICALLY OPERATING CLEANING INSTALLATION FOR WORKPIECES

Figure 1:
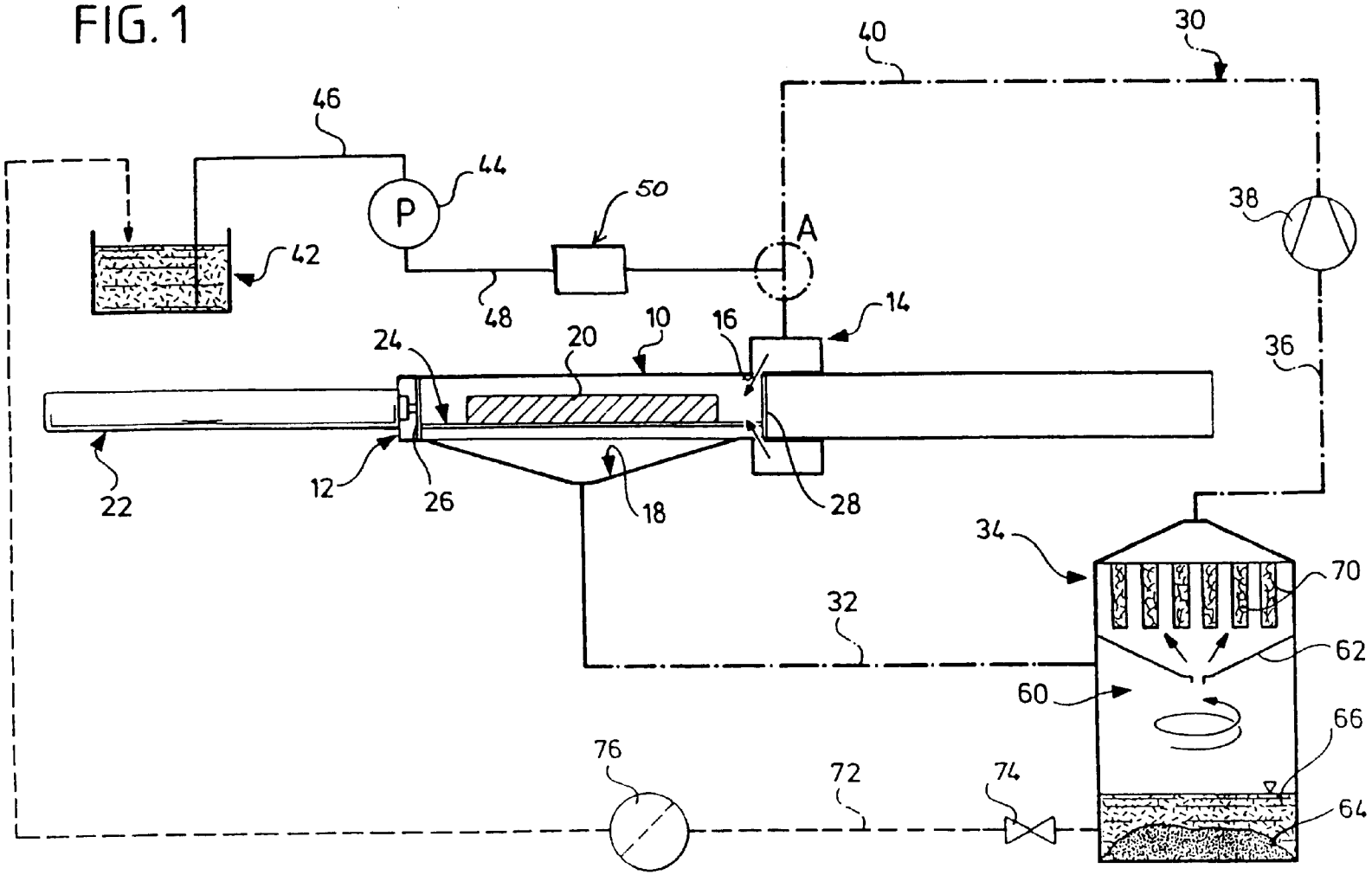

The present disclosure relates to the subject matter disclosed in application No. 196 37 086.8 of Sep. 12, 1996, the entire specification of which is incorporated herein by reference.

In many cases, workpieces, in particular, such as have been machined by grinding, drilling, milling, turning, sawing, thread cutting and the like, require thorough cleaning in order to remove chips, abrasive grains and the like, but, above all, also residues of machining fluids such as cutting and cooling oils, or other machining residues, as completely as possible. However, workpiece cleaning, for example, degreasing, can also prove necessary following other treatment processes.

To date, such cleaning has taken place, in practice, almost exclusively by the workpieces being cleaned with a cleaning liquid (organic solvents or aqueous cleaning liquids containing surfactants) by spraying and/or dipping and then being dried.

Another primitive way of cleaning workpieces without the use of a cleaning liquid is common, in particular, in metalworking factories: After machining, the workpiece is manually blasted by means of a compressed air nozzle with the result that chips and other machining residues are blown into the environment, which results in a highly disturbing soiling of the working area.

A cleaning installation with which dust is to be blown off the surfaces of workpieces such as, for example, vehicle bodies to be painted, is already known from DE-A-34 19 028. This known installation is provided with a channel-type lock chamber which can be closed at both of its ends by a lift gate at the inlet side and a lift gate at the outlet side. Arranged in the lock chamber is a roller conveyor which extends over the entire length of the lock chamber and on which the articles to be cleaned are deposited and with which the articles are moved through the lock chamber. This known installation is also provided with an air circuit system with a fan for conveying air to two ring-shaped blow air channels which are arranged in spaced relation to one another in the longitudinal direction of the channel forming the lock chamber, and each of which is formed by four straight segments which protrude into the interior of the channel forming the lock chamber. Between the two blow air channels, the lock chamber is provided with a likewise ring-shaped air suction channel which is followed by two mechanical air filters connected one behind the other, from which the fan draws in the air again. The workpieces to be cleaned are conveyed in a clocked manner through the lock chamber with the aid of the roller conveyor. For this purpose, the lift gate on the inlet side is first opened, a first workpiece to be cleaned or a first batch of workpieces to be cleaned is then introduced into the lock chamber and deposited on the roller conveyor. After reaching a first position before the first blow air channel, the lift gate on the inlet side is closed, the air circuit is then set in operation, and the workpiece or workpieces conveyed through the first ring-shaped blow air channel and stopped before the second ring-shaped blow air channel. The lift gate on the inlet side is then opened again, the lock chamber charged with the next batch, the lift gate on the inlet side then closed again and the roller conveyor moved on by one step, with the first batch passing through the second ring-shaped blow air channel and the second batch through the first blow air channel, etc. Therefore, the workpieces to be cleaned must be introduced individually or in batches into the lock chamber, i.e., this known cleaning installation can only operate intermittently. In addition, relatively complicated workpiece handling devices are necessary to take the workpieces to be cleaned through the opened lift gate on the inlet side and deposit them on the roller conveyor and to remove the cleaned workpieces from the roller conveyor and take them through the opened lift gate on the outlet side.

A similar cleaning installation is known from DE-A-37 34 200, but this differs from the cleaning installation according to DE-A-34 19 028 in that cleaning is carried out with a high-pressure air jet generated by a high-pressure fan.

However, the cleaning installation known from DE-A-34 19 028 is basically unsuitable for many uses because it is not possible with jets of blow air to remove dried or oily/fatty dirt, as is often typical of machined workpieces, to a sufficient extent from such workpieces. On the other hand, workpiece cleaning by means of jets of blow air does, of course, have the advantages that there is no subsequent drying of the workpieces involved, and that it is also not necessary to convey and recondition again and again large amounts of cleaning liquid, as is necessary with the cleaning of workpieces with a cleaning liquid by means of dipping and/or spraying.

The above-mentioned advantages and disadvantages of the cleaning installation according to DE-A-34 19 028 essentially also apply to the cleaning installation of Dürr GmbH known from DE-A-44 25 765, but it operates with a jet of compressed air and is designed such that it can operate continuously and is more cost-effective as it requires neither lift gates nor complicated workpiece handling devices.

The object underlying the invention is to use, in an automatically operating cleaning installation, the advantages of cleaning the workpieces with jets of air, but, at the same time, to clearly improve the cleaning effect, more particularly, also when, for reasons of energy costs, the cleaning is carried out with streams of blow air and not with high-pressure air, although the latter is, in principle, also conceivable.

The basic concept underlying the invention is to add to a stream of air effecting the cleaning a relatively small amount of steam in such a way that the stream of air impinging on a workpiece to be cleaned contains the water at least predominantly in vapor form. For, it has been found that unexpectedly good cleaning results are obtained when instead of pure air, a mixture of air and steam acts upon the workpiece to be cleaned, more particularly, even when the steam component of the stream of blow air is relatively low. On the one hand, even good degreasing of the workpieces is possible, and, on the other hand, the workpieces dry quickly after the cleaning operation when only the low amount of steam required for carrying out the cleaning operation is added to the stream of air.

Although the cleaning mechanism is not explained to the last detail, it obviously depends on the combination of a flow of air, preferably blow air, and steam acting on the workpiece, for the cleaning results obtainable with the invention are not obtainable with the known pure steam-jet apparatus available on the market, and, in particular, after cleaning with a steam-jet apparatus, the workpieces are not dry and so a separate drying station would have to be provided in a production and/or assembly line.

Proceeding from an automatically operating cleaning installation for removing treating and/or machining residues from workpieces, comprising a cleaning station having associated therewith a channel for receiving at least one workpiece to be cleaned, a workpiece transportation device for introducing the workpieces to be cleaned into the channel and for removing the cleaned workpieces from the channel, and at least one blow nozzle directed into the interior of the channel and thus onto the workpieces to be cleaned for acting upon the workpieces with a stream of air, in particular, a stream of blow air, an air feeder, in particular, in the form of a ventilator, for supplying air to the blow nozzle at a pressure of, in particular, at most approximately 0.5 bar being connected to the blow nozzle upstream thereof, and the channel including an outlet for withdrawing the used blow air, the above-mentioned object is structurally accomplished in accordance with the present invention by provision of a steam supplying device for introducing steam into the stream of blow air and a separating device for separating from the used blow air contaminated condensate originating from the steam, the steam supplying device and the air feeder being adapted to one another in such a way that the stream of blow air contains at most approximately 25 g steam per $m^3$ air.

The good cleaning effect achievable with the invention possibly resides, among other things, in the fact that in a cleaning with steam, completely desalted water or the vapor thereof acts on the workpiece and completely desalted water is "more aggressive" than normal water, i.e., takes up dirt more easily than non-desalted water; but, at the same time, the cleaning by means of streams of air with comparatively small amounts of steam added thereto results in the cleaned workpieces being dry again or drying off quickly by themselves immediately after the cleaning.

Although the cleaning according to the invention produces a very good cleaning effect, it is carried out in an extremely gentle way and so, for example, the paint on a painted workpiece surface remains undamaged. Also, a small amount of anticorrosive agent can be readily added to the water to be evaporated for the cleaning according to the invention in order to prevent corrosion of the cleaned workpieces.

With those means with which the condensate resulting from the used steam can be separated from the blow air in the inventive cleaning installation, machining and treating residues carried along by the used blow air can also be separated from the used blow air, and so it is, in principle, possible to conduct the used blow air into the environment or into the open. Furthermore, only comparatively small amounts of contaminated condensate accumulate and have to be disposed of or reconditioned.

A further great advantage of the invention is to be seen in the fact that the means to be provided in accordance with the invention can readily be fitted subsequently in each cleaning installation operating with streams of air.

The dirt removed from the workpieces can also be easily separated from the steam condensate, in particular, with a conventional centrifugal cyclone separator, and so it is possible to employ the used water, possibly including anticorrosive agent, again after appropriate reconditioning, although the small amounts of water required for cleaning according to the invention readily permit an economical disposal.

A device known from DE-A-44 40 146 for cleaning articles comprises a) a conventional high-pressure cleaning apparatus with a steam generator for generating high-pressure, hot steam, b) an air compressor for generating a jet of compressed air, and c) a gun-type spray lance, as used together with the conventional high-pressure cleaning devices, the high-pressure, hot steam and the compressed air being united in this spray lance, more particularly, a short distance before the outlet opening of the spray lance, and, in addition, a granular blasting agent being introduced into the jet of compressed air before the steam is introduced into the jet of compressed air. As this known cleaning device is a so-called jet device by means of which the articles to be cleaned are acted upon with a high-velocity jet of compressed air which carries the granular blasting agent along with it, this known cleaning device is, for this reason alone, unsuitable for gentle workpiece cleaning, which would allow even painted workpieces to be cleaned without the painted workpiece surface being damaged. Furthermore, a known high-pressure cleaning device with a steam generator results in the jet of compressed air carrying the granular blasting agent along with it in this known cleaning device containing a high component of steam, and so the cleaned articles are wet after the cleaning and would have to undergo a separate drying operation if this known cleaning device were used in a production and/or assembly line.

A further cleaning device known from DE-A-41 22 864 operates with steam, more particularly, a cleaning device for cleaning articles soiled with earth, stonework, roads or the like, but also for peeling field crops such as potatoes, sugar beet and the like. In this known cleaning device air is compressed so strongly by a compressor that the air is thereby heated, and the highly compressed, warm or even hot air possibly has a liquid such as water added to it. The liquid component is so high that when the mixture of air and liquid is cooled down to below 0° C., the crops to be cleaned are peeled by particles of frozen liquid, as in the blasting with a granular blasting agent. It is, therefore, obvious that with this known cleaning device the operation is carried out with a relatively high water component in the cleaning jet.

With the inventive cleaning installation, the steam can be added to the stream of air upstream of the blow nozzle. It is, however, advantageous to add the steam to the stream of air as short a distance as possible before or even inside the blow nozzle, in order that the steam will strike the workpiece to be cleaned to as great an extent as possible in vapor form, and as small amounts of steam as possible will be required.

As organic or other liquids which pollute the environment do not have to be used in the invention, it is not necessary to provide a channel which is closed at its circumference. Therefore, the channel of the inventive cleaning installation could, for example, have a U-shaped cross section and be open at the top or it could be formed only by two splash guard walls at the sides extending parallel to each other in the direction of movement of the workpieces. However, embodiments are preferred wherein the channel is closed on all sides except for an inlet opening and an outlet opening for the workpieces which, in particular, are closeable. Such embodiments enable further improvement of the cleaning installation according to the invention by the blow air being circulated at least almost entirely in the circuit. A corresponding embodiment is characterized by a closed blow air circuit comprising the channel and the air feeder, the blow nozzle and the condensate separating device (not taking into account the possibility that the inlet and outlet openings of the channel are not closed gas-tight so long as the workpiece is or workpieces are being cleaned). Too high a moisture content in the circulated blow air is avoided in this embodiment by the blow air circuit being designed such that the steam added to the blow air is at least substantially condensated out downstream of the cleaning location.

In order that the air feeder will be impaired as little as possible by the steam or steam condensate and the dirt contained therein, it is recommended that the condensate separating device be arranged downstream of the outlet of the channel and upstream of the air feeder, and in order to separate from the blow air before the air feeder dirt which has also been carried along by the actual blow air, it is recommended that a dirt separating device for separating from the blow air dirt removed from the workpieces also be provided in the blow air circuit downstream of the outlet of the channel and upstream of the air feeder. This dirt separating device may be a simple mechanical filter.

Differently from the cleaning installation known from DE-A-34 19 028, but in correspondence with the cleaning installation according to DE-A-44 25 765, for the cleaning installation according to the invention it is recommended that the outlet of the channel be arranged at a bottom of the channel in order to take into account the fact that the walls of the channel act as baffle walls for the condensate droplets carried along by the blow air or used blow air, i.e., as liquid separating elements.

The blow air nozzle or several blow air nozzles could be held by a robot-like handling device and moved along the workpieces to be cleaned and/or around these. However, it is simpler to design the blow nozzle such that it has an air outlet opening at least essentially surrounding the workpiece to be cleaned and blow nozzle and workpiece are moved relative to each other transversely to this air outlet opening, more specifically, by the workpieces being guided by the workpiece transportation device through the blow nozzle. In this case it is particularly advantageous for an area of the transportation device carrying the workpiece to be permeable to air transversely to the longitudinal direction of the channel as the blow air including the steam carried along with it can then be directed from all directions onto the workpieces carried by the transportation device.

As will be clear from the above statements, embodiments are preferred wherein the air conveyor does not convey the blow air at high pressure to the blow nozzle, as the energy requirement of the cleaning installation is thereby minimized. In this case, very good cleaning results are obtained when the air conveyor is designed so as to convey at least approximately 600 $m^3$/h of blow air per blow nozzle.

For most uses it has proven sufficient for approximately 3 to approximately 15 kg/h of steam to be added to the blow air per blow nozzle. In a preferred embodiment of the inventive cleaning installation, the steam is supplied by a steam generator which is designed such that the steam has a pressure of approximately 0.5 to 8 bar and a temperature of approximately 110° C. to 200° C. If an anticorrosive agent is to be added to the water to be evaporated, it is fully adequate for the water to contain at most 0.5% by volume, preferably only 0.1 to 0.2% by volume of the anticorrosive agent.

The addition of comparatively small amounts of steam to the blow air makes it possible to deliver the blow air to the blow nozzle at a relatively speaking very low overpressure, and so, in preferred embodiments of the inventive cleaning installation, the air feeder is designed such that the air is supplied to the blow nozzle at a pressure of at most approximately 0.3 bar, preferably of only approximately 0.2 bar.

Particularly good cleaning results are obtained when air feeder, blow nozzle and steam supplying device are designed such that the discharge velocity of the mixture of air and steam at the blow nozzle is approximately 100 to 300 m/sec.

In order that the steam added to the blow air will also actually impinge to as great an extent as possible on the workpiece to be cleaned, embodiments are recommended wherein the steam is introduced into the stream of blow air approximately 2 to 20 cm upstream of the outlet opening of the blow nozzle—in dependence upon the design of the blow nozzle, the steam should be added to the air stream at as short a distance as possible before the outlet opening of the nozzle, but always expanded before the blow nozzle.

Furthermore, it is recommended that the spacing of the outlet opening of the blow nozzle from the workpiece to be cleaned be chosen as small as possible, and, therefore, in preferred embodiments of the inventive cleaning installation, this spacing, also in dependence upon the contours of the workpieces to be cleaned, is approximately 0.1 to 5 cm.

The amount of steam to be added to the blow air per time unit can be controlled via the power supplied to the steam generator. It may, however, be recommendable to supply the water to the steam generator by means of a metering pump, more specifically, preferably by means of a metering pump which is adjustable with respect to its delivery rate.

Figure 2:
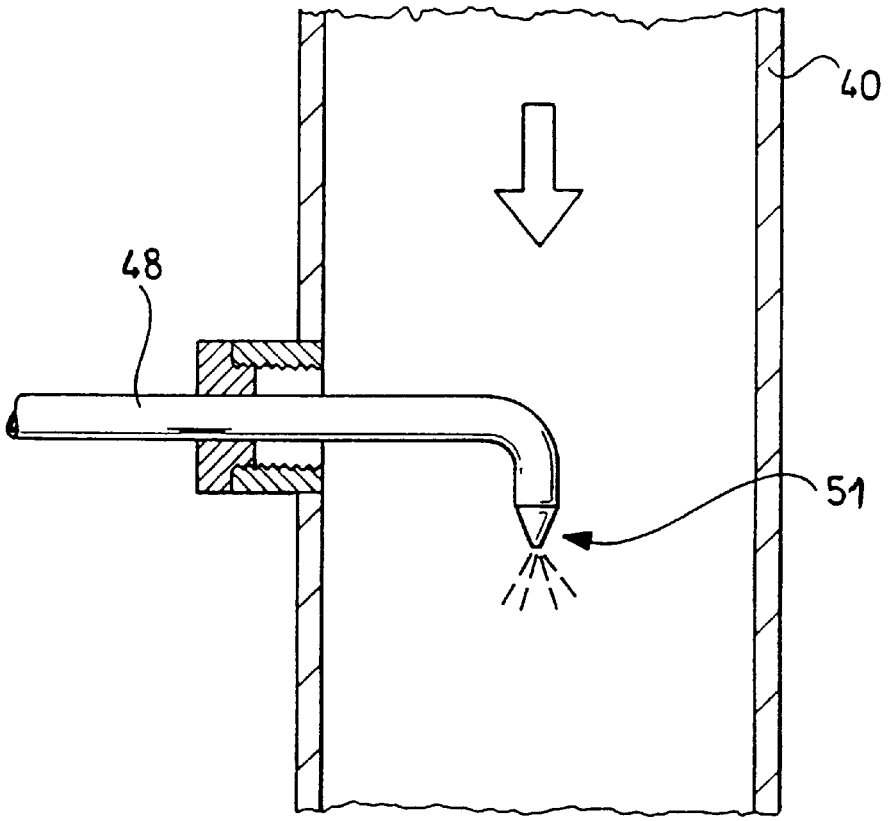

Further features, advantages and details of the invention are apparent from the enclosed claims and/or the following description and the appended drawings of a particularly advantageous embodiment of the cleaning installation according to the invention. The drawings show:

| | |
|---|---|
| FIG. 1 | a schematic illustration of the cleaning installation; and |
| FIG. 2 | the section designated "A" in FIG. 1 in detail and on a larger scale. |

The cleaning installation illustrated in its entirety in FIG. 1 comprises a channel 10 which is closed throughout its circumference—except for openings to be described hereinbelow—but is open at both of its end faces. The left end face according to FIG. 1 thus forms an inlet/outlet opening 12 for the workpieces to be cleaned. Approximately at the center thereof, the channel 10 is surrounded by a ring-shaped blow nozzle 14 comprising a likewise ring-shaped nozzle opening 16 indicated by arrows—the wall of the channel 10 has a ring-shaped slot at this location. Accordingly, the blow nozzle 14 does preferably not protrude into the interior of the channel 10 and, in particular, it is designed such as described and illustrated in DE-A-44 25 765. As indicated by the arrows in FIG. 1, the nozzle opening 16 is oriented such that the blow nozzle 14 generates a ring-shaped stream of blow air which is directed into the interior of the channel 10 and is inclined somewhat in the direction towards the inlet/outlet opening 12.

On the left of the blow nozzle 14 according to FIG. 1, the bottom of the channel 10 is formed by a suction funnel 18, whereas the inner cross section of the channel 10 is otherwise constant throughout its entire length.

Associated with the inlet/outlet opening 12 is a workpiece transportation device with which a workpiece 20 to be cleaned can be introduced into the channel 10 through the inlet/outlet opening, pushed through the nozzle opening 16 and then pulled out of the channel 10 again. This workpiece transportation device comprises a slide rod 22 extending in the longitudinal direction of the channel 10. The slide rod 22 is held by means, not illustrated, and can be pushed back and forth in the longitudinal direction of the channel 10. The workpiece transportation device also comprises a workpiece carrier 24 which is held by the slide rod 22 and has attached to each of its two ends a partition 26 and 28, respectively. The workpiece carrier 24 forms a support which is of air-permeable design in the vertical direction for a workpiece 20 to be cleaned, whereas the two partitions 26 and 28 are air-impermeable and—except for the area of the suction funnel 18—can slide sealingly along the inside wall of the channel 10. In accordance with the invention, the workpiece carrier 24 is of such length that after introduction of a workpiece 20 to be cleaned into the channel 10, in the initial position of the workpiece carrier illustrated in FIG. 1, the partition 28 is located somewhat behind, i.e., according to FIG. 1 on the right of the nozzle opening 16, for the cleaning operation, whereas the partition 26 is located approximately at the left end of the suction funnel 18 according to FIG. 1.

The channel 10 including the blow nozzle 14 is a component of an at least essentially closed blow air circuit 30, the parts of which will be described hereinbelow:

There is located at the bottom of the suction funnel 18 an outlet opening, not illustrated in further detail, to which a first exhaust line 32 is connected. The exhaust line 32 leads to a barrel-shaped separating device 34 having at the top side thereof an outlet opening, not illustrated in further detail, to which a second exhaust line 36 is connected. The exhaust line 36 connects the separating device 34 to the suction side of a blow air ventilator 38, to the outlet of which a blow air line 40 is connected. The blow air conveyed by the ventilator 38 is supplied by this blow air line 40 to the blow nozzle 14.

A cleaning liquid to be used in the cleaning process, i.e., water or water containing an anticorrosion additive, is stored in a cleaning liquid tank 42. By means of a metering pump 44 and a suction line 46, cleaning liquid is drawn out of the cleaning liquid tank 42 and conveyed into a pressure line 48 comprising a steam generator 50 which, in particular, is adjustable with respect to its output. As shown in FIG. 2, the pressure line 48 leads in a sealed manner into the blow air line 40 and terminates there in a nozzle 51, with the aid of which the steam is blown into the stream of blow air and expanded a short distance upstream of the blow nozzle 14. The blowing-in of the steam somewhat upstream of the ring-shaped blow nozzle 14 has the advantage that a single nozzle 51 suffices, and there is no necessity for several nozzles to be distributed over the circumference of the blow nozzle 14.

The separating device 34 comprises approximately half way up it a centrifugal cyclone separator 60, which can be of a design known per se, and, therefore, does not need to be described in detail or illustrated in the drawing. It serves to separate from the flow of blow air drawn out of the channel 10 by the ventilator 38 via the exhaust line 32 steam condensate and possibly corrosive agent droplets and dirt which was removed from the cleaned workpiece, more specifically, with the aid of centrifugal forces which are generated by the blow air to be cleaned forming a vortex in the centrifugal cyclone separator 60, more particularly, below an approximately funnel-shaped partition wall 62 of the separating device 34. Solid particle dirt 64 originating from the cleaned workpiece then deposits at the bottom of the separating device 34, while condensate 66 soiled, for example, by cutting oils, settles above the solid particle dirt 64 in the separating device 34. The blow air cleaned by the centrifugal cyclone separator 60 travels through an opening at the center of the partition wall 62 into the upper part of the separating device 34 where it passes through exchangeably arranged filter candles 70, and the thus further cleaned blow air then enters the exhaust line 36.

Somewhat above the deposited solid particle dirt 64, the soiled condensate 66 is withdrawn from the separating device 34, more specifically, by means of a discharge line 72 which preferably contains a valve 74. The discharge line 72 leads to a reconditioning device 76, shown only schematically, in which, in a manner known per se, fats, oils or other similar impurities are separated from the condensate. The reconditioning device 76 is also to contain a pump with which the reconditioned condensate is conveyed back into the cleaning liquid tank 42.

Instead of a single workpiece 20, illustrated in FIG. 1, the workpiece carrier 24 can, of course, also be loaded with several workpieces to be cleaned.

After the workpiece carrier 24 has been introduced with the workpiece to be cleaned into the channel 10 and has assumed its initial position illustrated in FIG. 1, the ventilator 38, the metering pump 44 and the steam generator 50 are switched on and the workpiece carrier 24 is moved slowly from the left to the right according to FIG. 1 until all areas of the workpiece to be cleaned have passed the ring-shaped nozzle opening 16. The workpiece carrier 24 is then drawn back from the right to the left according to FIG. 1 into its initial position illustrated in FIG. 1 and pulled towards the left together with the cleaned workpiece out of the channel 10.

In order that blow air and dirt cannot escape from the interior of the channel 10 in spite of the suction funnel 18, the slide rod 22 can be replaced by a double acting, horizontally displaceable pressure medium cylinder which is provided with a piston rod holding the workpiece carrier 24 and, in addition, with a partition which, after the workpiece carrier 24 has been pushed into the channel 10, closes the left end of the channel 10 in accordance with FIG. 1 in an air-tight manner—on account of the partition 28 neither blow air nor dirt can escape from the right open end of the channel 10 during the cleaning operation.

As mentioned above, the channel and the workpiece transportation device could, however, also be designed as described and/or claimed in DE-A-44 25 765.

In order to obtain absolutely dry workpieces with the inventive cleaning installation, a modification of the illustrated embodiment is recommended wherein a steam valve is arranged between the steam generator 50 and the outlet opening of the nozzle 51 in order to cut off the supply of steam to the blow air shortly before termination of the cleaning operation—the further acting on the workpiece solely with blow air then results in an absolutely complete and reliable drying of the cleaned workpieces.

What is claimed is:

1. Automatically operating cleaning installation for removing (treating and/or machining) residues from workpieces, comprising a cleaning station having associated therewith a channel for receiving at least one workpiece to be cleaned, a workpiece transportation device for introducing workpieces to be cleaned into said channel and for removing the cleaned workpieces from said channel, and at least one blow nozzle directed into the interior of said channel and thus onto said workpieces to be cleaned for acting upon said workpieces with a stream of blow air, an air feeder for supplying air to said blow nozzle at a pressure of at most approximately 0.5 bar being connected to said blow nozzle upstream thereof, and said channel including an outlet for withdrawing the used blow air, wherein a steam supplying device for introducing steam into said stream of blow air and a separating device for separating from said used blow air contaminated condensate originating from said steam are provided, said steam supplying device and said air feeder being adapted to one another such that said stream of blow air at said blow nozzle contains at most approximately 25 g steam per $m^3$ air.

2. Installation as defined in claim 1, wherein except for an inlet opening and an outlet opening for said workpieces, said channel is closed on all sides thereof.

3. Installation as defined in claim 2, including a closed blow air circuit comprising said channel and said air feeder, said blow nozzle and said condensate separating device.

4. Installation as defined in claim 3, wherein said condensate separating device is arranged downstream of said outlet of said channel and upstream of said air feeder.

5. Installation as defined in claim 3, wherein said blow air circuit comprises downstream of said outlet of said channel and upstream of said air feeder a dirt separating device for separating from said blow air dirt removed from said workpieces.

6. Installation as defined in claim 5, wherein said dirt separating device comprises a mechanical filter.

7. Installation as defined in claim 5, wherein said dirt separating device also forms said condensate separating device.

8. Installation as defined in claim 6, wherein said separating device comprises a container with a lower collecting area for condensate and dirt, wherein said filter is arranged in said container above said collecting area, and wherein a container inlet for the mixture of blow air, steam and condensate is arranged between said collecting area and said filter, and a container outlet for blow air is arranged on the side of said filter facing away from said collecting area.

9. Installation as defined in claim 1, wherein said outlet of said channel is arranged at a bottom of said channel.

10. Installation as defined in claim 1, wherein said blow nozzle has an air outlet opening at least essentially enclosing said workpiece to be cleaned, and said blow nozzle and said workpiece are moveable relative to each other transversely to this air outlet opening.

11. Installation as defined in claim 1, wherein said workpiece transportation device comprises an endless conveyor element extending through said channel.

12. Installation as defined in claim 11, wherein said transportation device is moveable through said air outlet opening of said blow nozzle.

13. Installation as defined in claim 11, wherein the area of said conveyor element carrying said workpiece is permeable to air transversely to the longitudinal direction of said channel.

14. Installation as defined in claim 1, wherein said air feeder is designed such that it conveys at least approximately 500 to 600 $m^3/h$ of blow air per blow nozzle.

15. Installation as defined in claim 1, wherein said steam supplying device comprises a steam generator for blowing said steam into said stream of blow air.

16. Installation as defined in claim 15, wherein said steam generator is designed for generating an amount of steam of approximately 1 to approximately 15 kg/h per blow nozzle.

17. Installation as defined in claim 16, wherein said steam generator is designed for generating steam at a pressure of approximately 0.5 to 8 bar and a temperature of approximately 110° C. to 200° C.

18. Installation as defined in claim 1, wherein said steam supplying device is designed for evaporating water containing up to approximately 0.5% by volume, of an anticorrosive agent.

19. Installation as defined in claim 1, wherein said air feeder is designed such that the air is supplied to said blow nozzle at a pressure of at most approximately 0.3 bar.

20. Installation as defined in claim 1, wherein a steam condensate recirculating system is provided with a reconditioning device for said condensate.

21. Installation as defined in claim 1, wherein said steam supplying device and said blow nozzle are designed such that the discharge velocity of the mixture of air and steam at said blow nozzle is approximately 100 to 300 m/sec.

22. Installation as defined in claim 1, wherein said steam is introduced into said stream of blow air and expanded at approximately 2 to 20 cm upstream of said outlet opening of said blow nozzle.

23. Installation as defined in claim 1, wherein said outlet opening of said blow nozzle is spaced at approximately 0.1 to 5 cm from said workpiece to be cleaned.

24. Installation as defined in claim 15, including a metering pump for feeding said steam generator with water.

25. Installation as defined in claim 24, wherein said metering pump is adjustable with respect to its delivery rate.

26. Installation as defined in claim 1, wherein said air feeder is a ventilator.

27. Installation as defined in claim 18, characterized in that said steam supplying device is designed for evaporating water containing 0.1 to 0.2% by volume of an anticorrosive agent.

28. Installation as defined in claim 19, charaterized in that said air feeder is designed such that the air is supplied to said blow nozzle at a pressure of approximately 0.2 bar.

29. Installation of claim 2, wherein said inlet opening and said outlet opening are closeable.

* * * * *

UNITED STATES PATENT AND TRADEMARK OFFICE

CERTIFICATE OF CORRECTION

PATENT NO. : 6,119,365
DATED : September 19, 2000
INVENTOR(S) : Karl-Heinz Wuller, et al.

It is certified that error appears in the above-identified patent and that said Letters Patent is hereby corrected as shown below:

Column 1,
Line 2: replace "(treating and/or machining)" with --- treating and/or machining ---.

Column 10,
Line 3: replace "volume," with --- volume ---.

Claim 27:
Replace in its entirety:
Installation of Claim 18, wherein said water comprises 0.1 to 0.2% by volume of said anticorrosive agent.

Claim 28:
Replace in its entirety:
Installation of Claim 19, wherein said air is supplied at a pressure of about 0.2 bar.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*